US006509088B2

(12) United States Patent
Baxter

(10) Patent No.: US 6,509,088 B2
(45) **Date of Patent: *Jan. 21, 2003**

(54) METAL MATRIX COMPOSITES WITH IMPROVED FATIGUE PROPERTIES

(75) Inventor: William J. Baxter, Bloomfield Hills, MI (US)

(73) Assignee: General Motors Corporation, Detroit, MI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/286,643

(22) Filed: Apr. 2, 1999

(65) Prior Publication Data

US 2002/0098337 A1 Jul. 25, 2002

(51) Int. Cl.[7] ..... B32B 15/04

(52) U.S. Cl. ..... 428/293.1; 428/313.3; 428/220

(58) Field of Search ..... 428/293.1, 313.3, 428/220

(56) References Cited

U.S. PATENT DOCUMENTS

| | | | | |
|---|---|---|---|---|
| 4,298,385 A | | 11/1981 | Claussen et al. | 501/105 |
| 4,867,931 A | | 9/1989 | Cochran, Jr. | 264/9 |
| 4,995,444 A | * | 2/1991 | Jolly et al. | 164/97 |
| 5,135,895 A | | 8/1992 | Frechette et al. | 501/95 |
| 5,380,580 A | * | 1/1995 | Rogers et al. | 428/219 |
| 5,405,571 A | | 4/1995 | Truckner et al. | 419/8 |
| 5,476,684 A | | 12/1995 | Smith | 427/228 |
| 5,511,603 A | | 4/1996 | Brown et al. | 164/97 |
| 5,552,049 A | | 9/1996 | Gray | 210/490 |
| 5,579,532 A | | 11/1996 | Edd | 419/2 |
| 5,579,571 A | | 12/1996 | Park et al. | 29/762 |
| 5,580,835 A | | 12/1996 | Wright et al. | 501/95 |
| 5,588,477 A | | 12/1996 | Sokol et al. | 164/34 |
| 5,679,041 A | | 10/1997 | Sokol et al. | 442/59 |
| 5,705,444 A | | 1/1998 | Tompkins et al. | 442/76 |

* cited by examiner

*Primary Examiner*—Elizabeth M. Cole
(74) *Attorney, Agent, or Firm*—Kathryn A. Merra

(57) ABSTRACT

A metal matrix composite and method of making same wherein a metallic matrix includes fibrous reinforcements and non-fibrous pest particles that have shell walls controlled thick enough to improve fatigue properties of the composite.

6 Claims, 6 Drawing Sheets

FIG. 3A 100μm

METAL MATRIX COMPOSITES WITH IMPROVED FATIGUE PROPERTIES

FIELD OF THE INVENTION

The present invention relates to metal matrix composites having improved fatigue properties.

BACKGROUND OF THE INVENTION

It is well known in the art to improve one or more properties (e.g. strength, toughness, wear resistance, fatigue resistance, etc.) of metals and alloys by inclusion of reinforcing particles therein, either as dispersed particles or as one or more preformed inserts formed from particulates. The reinforcing particles can comprise elongated fibers, rounded particles, and other particle shapes. Such reinforced metals or alloys are referred to as metal matrix composites (MMC's) wherein the metal or alloy provides the matrix for the reinforcing particles. Metal matrix composites having various reinforcing particles and matrix metals/alloys are described in U.S. Pat. Nos. 5,679,041 and 5,588,477.

An object of the present invention is to provide a metal matrix composite and method of making same that incorporates fibrous reinforcements together with non-fibrous particles having certain particle dimensions controlled in a manner that improves fatigue properties of the composite.

SUMMARY OF THE INVENTION

The present invention provides a metal matrix composite and method of making same wherein a metallic matrix includes fibrous reinforcements that are present in the matrix together with non-fibrous particles typically present with the fiber reinforcements as incidental or pest particles, although they may be present intentionally as well. The non-fibrous particles have a shell morphology and can exist in the matrix as harmless shells filled with the matrix metal/alloy and also as harmful hollow shells exerting an adverse affect on fatigue properties of the composite. In accordance with the present invention, the non-fibrous particle shells have shell wall thicknesses controlled thick enough to improve fatigue properties of the composite, rather than detract from the fatigue properties. In particular, the fibrous reinforcements and non-fibrous particles are formed in a manner that the non-fibrous particle shell walls are in a range of thicknesses found to improve fatigue properties of the composite.

In an illustrative embodiment of the present invention offered for purposes of illustration only and not limitation, the fibrous reinforcements and non-fibrous particles comprise the same ceramic material, such as aluminosilicate, melt spun in a manner that provides predominantly relatively thick-walled non-fibrous particles having a shell wall thickness, t, and external shell radius, a, such that the ratio, t/a, is greater than about 0.2. When such fiber reinforcements and relatively thick-walled non-fibrous particles are incorporated into an aluminum based matrix, the resulting composite exhibits improved fatigue properties as compared to a similar composite having like fiber reinforcements but including thinner-walled non-fibrous particles.

The present invention envisions in a particular illustrative embodiment an improved piston for use in an internal combustion engine wherein the piston includes at least at a local region the above metal matrix composite structure to impart improved fatigue properties to the region. The reinforced region may include the crown, dome or ring groove region of the piston.

The above and other objects and advantages of the present invention will become more readily apparent from the following detailed description taken in conjunction with the following drawings.

DESCRIPTION OF THE DRAWINGS

FIGS. 3A and 3B are optical micrographs of MMC test specimens incorporating "blown" KAOWOOL fiber reinforcements in the 339 aluminum alloy matrix showing a hollow, thin-walled "shot" particle filled with the matrix alloy.

DESCRIPTION OF THE INVENTION

Figure 1:
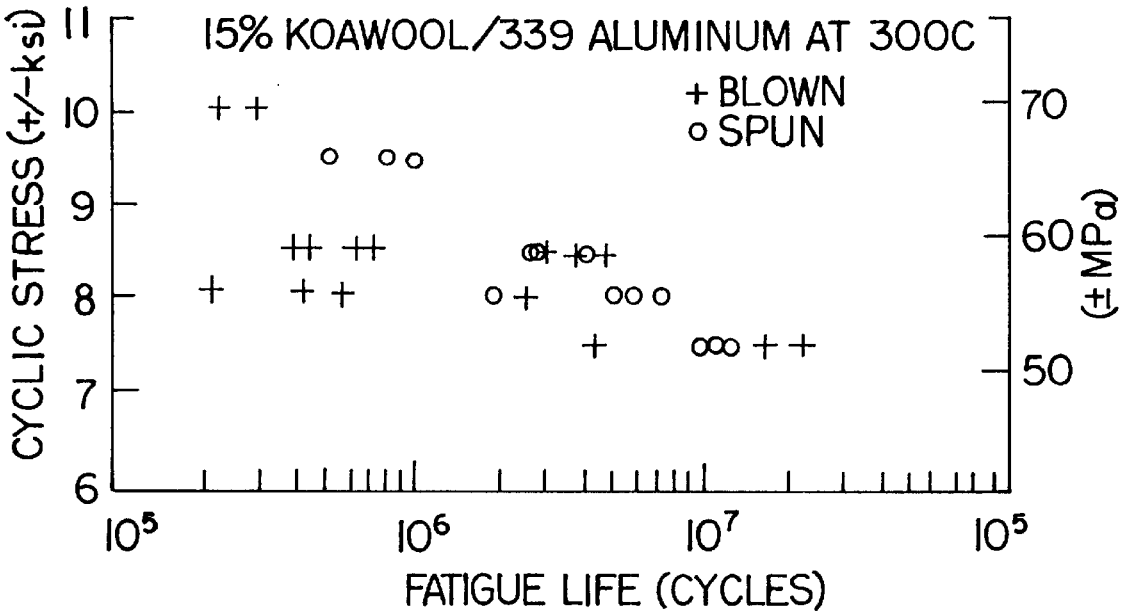
FIG. 1 is a graph of applied cyclic stress versus number of cycles to failure at 300 degrees C for MMC specimens with 15 volume % of "blown" KAOWOOL fibers in a 339 aluminum alloy matrix as designated by the "+" data points and also MMC specimens with 15 volume % of "spun" KAOWOOL fibers in the same aluminum alloy matrix as designated by the "○" data points.

The present invention will be described in detail below with respect to metal matrix composites (MMC's) having a reinforcing preform disposed in an aluminum based matrix wherein the preform comprises KAOWOOL (aluminosilicate) fiber reinforcements and non-fibrous particles formed incidentally with the fiber reinforcements during manufacture. However, this description is offered only for purposes of illustrating the invention and not limiting it. The present invention can be practiced using a variety of fiber reinforcements and non-fibrous particles as well as a variety of metallic matrices. For example, the fiber reinforcements and non-fibrous particles may comprise materials including, but not limited to, carbon/graphite, alumina, glass, mica, silicon carbide, silicon nitride, wollastonite, potassium titanate fiber, zirconia, yttria, aluminosilicate and other appropriate reinforcing materials. The non-fibrous particles typically are present as incidental or pest particles with the fiber reinforcements as a result of being formed during the same manufacturing process, although they may be intentionally included therewith so long as the non-fibrous particle dimensions are controlled pursuant to the present invention. Similarly, the metallic matrix can comprise a wide variety of metals and alloys including but not limited to aluminum and its alloys, magnesium and its alloys, and titanium and its alloys.

The fibrous reinforcements may be used in the form of one or more self-supporting preforms or as dispersed particulates at one or more selective regions of the metallic matrix or throughout the metallic matrix. That is, the fibrous reinforcements may extend throughout the entire casting defined by the metallic matrix, or may be located only at a selective region thereof, such as for example only, in the crown or dome of an internal combustion engine piston. If the fibrous reinforcements are used in the form of a self-supporting preform, the preform can be infiltrated with molten metal or alloy using die casting, squeeze casting or other casting technique effective to infiltrate the preform with the metal or alloy matrix.

For purposes of illustration only, metal matrix composites were made pursuant to the invention using porous preforms comprising KAOWOOL fibers (solid aluminosilicate fibers) including incidental non-fibrous particles disposed in a 339 aluminum alloy matrix nominally comprising 12 weight % Si, 1 weight % Cu, 1 weight % Mg, 1 weight % Ni, and 0.5 weight % Fe.

Initial MMC test samples were made using preforms comprising "blown" KAOWOOL fiber reinforcements made by Thermal Ceramics Corporation, Augusta, Ga., by impinging a high velocity air jet against a molten stream of Kaolin (aluminosilicate) in a manner that the high velocity air jet disperses the molten ceramic into droplets, approximately one-half of which are elongated into a fibrous form before they solidify and the remainder of which solidify into incidental non-fibrous particles known as "shot" particles. The "blown" KAOWOOL fibers typically have an average length of 100 microns and average diameter of 3 microns with an average aspect ratio of 30. The "shot" particles typically comprise hollow, approximately spheroid KAOWOOL shells in a size range from about 30 to 100 microns diameter. The manufacturer separated most of the incidental KAOWOOL "shot" particles from the KAOWOOL fibers using a hydrocyclone followed by ultrasonic elutriation. However, even after these separation operations, the "blown" KAOWOOL fibers include not only the desired fibers for reinforcement purposes in practice of the invention, but also a small amount of the "shot particles" formed incidental to the fibers as explained above. Removal of all of the "shot" particles from the elongated fibers has been impractical and/or impossible to date as a result of the large number of "shot" particles present. The "blown" KAOWOOL fibers include as a result a small fraction (e.g. approximately 1 volume %) of non-fibrous "shot" particles in the total mixture after the aforementioned separation operations.

Preforms comprising the "blown" KAOWOOL fibers together with the incidental "shot particles" were provided by Thermal Ceramic Corporation with the fibers/particles bonded together using a colloidal silica binder (e.g. 5 weight % colloidal silica and balance water) applied as a coating on the fibers/particles. The preforms were provided with a disc configuration having dimensions of 10 centimeters (cm) diameter×1.5 cm thick. The preforms were made by the process of vacuum forming by Thermal Ceramics Corporation.

The porous preforms were infiltrated with molten 339 aluminum alloy by squeeze casting using a preform temperature of 600 degrees C, metal temperature of 710 degrees C, and final applied squeeze pressure of approximately 70 MPa. MMC castings were made having 7, 15, and 23 volume % of the "blown" KAOWOOL fibers/particles relative to the total volume of each MMC casting. The MMC castings were aged for 8 hours at 210 degrees C to produce a so-called T5 heat treat condition prior to machining of cylindrical fatigue specimens from the aged castings. The fatigue specimens were machined in accordance with ASTM specification E446-96. The gauge section of each specimen was polished parallel to the cylindrical axis with diamond paste to ensure that there were no circumferential scratches perpendicular to the axis. The polished specimens were aged at 300 degrees C for 200 hours prior to cyclic fatigue testing at 300 degrees C under load control with R=−1 at 30 Hz.

The fractured fatigue specimens were examined at all fractured surfaces by scanning electron microscopy to identify the origin of crack initiation. Moreover, other pieces of the specimens were sectioned and polished for metallographic examination by both optical and scanning electron microscopy in order to characterize the "shot particle" geometries.

Figure 3B:
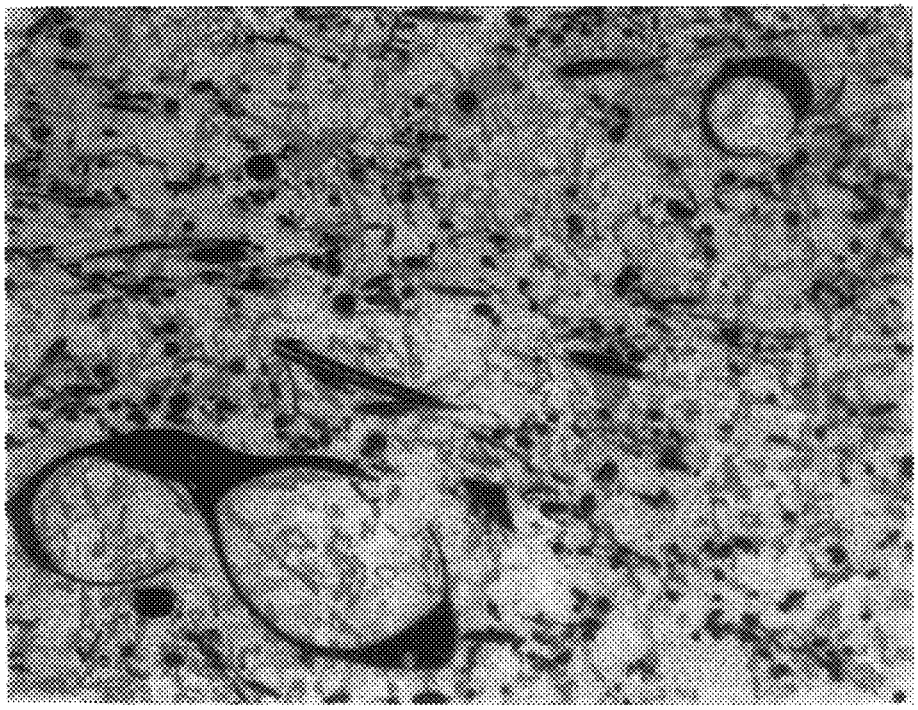
Figure 3B:
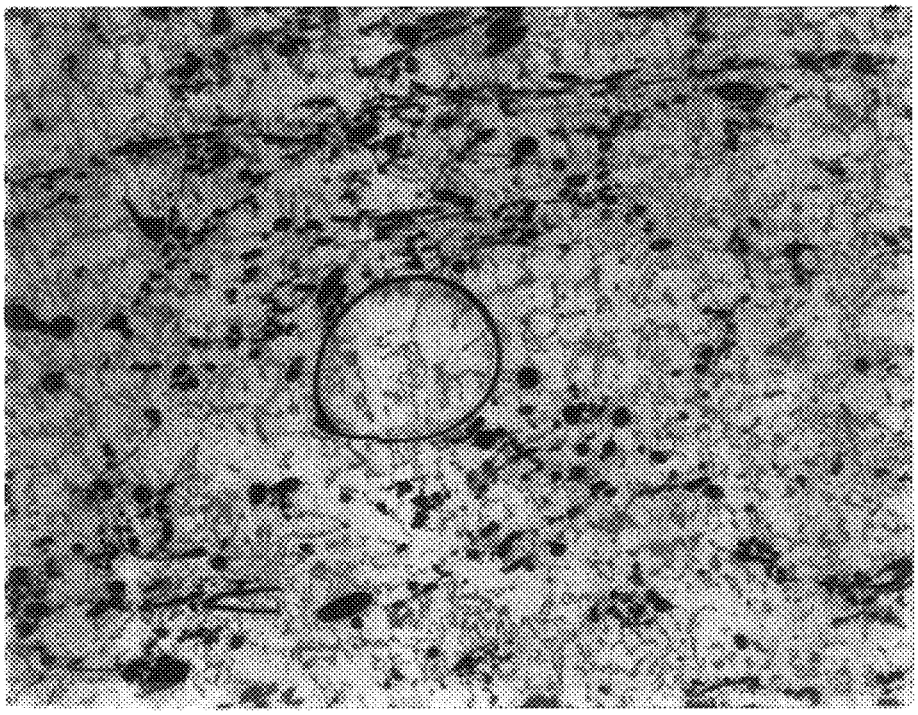

An area of approximately 20 $mm^2$ was surveyed on each polished section of the MMC specimens. Typical, "shot" particles present in the aluminum alloy matrix of the MMC specimens are illustrated in FIGS. 3A and 3B, which are scanning electron micrographs of the MMC with 15 volume % of the "blown" KAOWOOL fibers/particles. The "shot" particles were found to be approximately spheroidal, ranging in size up to approximately 100 microns in diameter. The particle wall or shell thickness was not uniform. However, the "shot" particles present as incidental or pest particles with the "blown" KAOWOOL fibers could be divided into two categories on the basis of the ratio of the shell wall thickness (t) to the particle shell external radius (a); namely, category (1) comprising relatively thin-walled particle shells with a t/a equal to or less than 0.2 and category (2) comprising relatively thick-walled particle shells with t/a equal to or greater than 0.2. Some small fraction of solid ceramic "shot" particles also were present.

Figure 2:
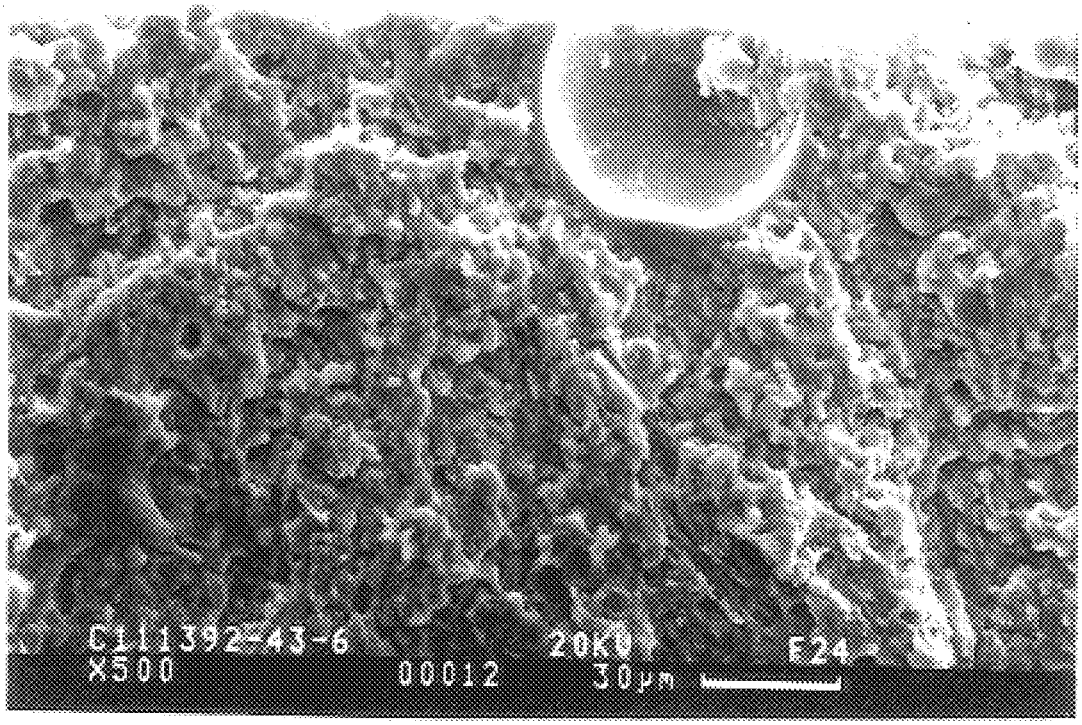
FIG. 2 is a scanning electron micrograph of a typical hollow "shot" particle found at a crack initiation site in MMC fatigue test specimens incorporating the "blown" KAOWOOL fiber reinforcements.

Approximately 99.5% of the thin-walled "shot" particles were observed to be fully filled with the matrix aluminum alloy, FIGS. 3A and 3B, after squeeze casting as a result of fracture of the thin-walled shells and infiltration of molten alloy therein. These matrix-filled "shot" particle are harmless to fatigue properties of the composite. However, some small fraction of the "shot" particles remained as hollow, empty shells in the matrix, FIG. 2, and, as will be explained below, are harmful to fatigue properties of the composite.

The surface concentrations of the "shot" particles per one $mm^2$ of exterior specimen surface as observed by optical microscopy is summarized in Table I where thick-walled and/or solid "shot" particles and also thin-walled "shot" particles were found to be present on the surface of the MMC specimen with 15 volume % of the "blown" KAOWOOL fibers.

TABLE I

Surface Concentrations ($mm^{-2}$) of Shot Particles Observed on Polished Sections of KAOWOOL/339 Aluminum Composites

| Fiber Type | Thick Wall* or Solid Shot | Thin Wall* Shot |
|---|---|---|
| Blown | 1.0 | 1.0 |
| Spun | 0.65 | 0 |

*Thick Wall = t/a > 0.2
**Thin Wall = t/a < 0.2

Referring to FIG. 1, the fatigue life as a function of cyclic stress (i.e. S-N curve) at 300 degrees C is shown and designated by the "+" data points for the metal matrix composite fatigue specimens using a preform providing 15 volume % of the "blown" KAOWOOL fibers/particles relative to the total volume of each specimen. It is apparent that the fatigue specimens including the "blown" KAOWOOL fibers/particles exhibited a large scatter in fatigue lives with some specimens cracking at very low cyclic stress values early during the fatigue life.

Similar fatigue tests were conducted using MMC fatigue specimens having preforms providing 7volume % and 23 volume % of the "blown" KAOWOOL fibers/particles relative to the total volume of each specimen. In the vast majority of these fatigue specimens, fatigue failure was observed to be initiated at hollow "shot" KAOWOOL particles as shown in the scanning electron micrograph of FIG. 2 with the wide scatter in fatigue lives being attributable primarily to presence of the hollow "shot" particles in proximity to the free surface of the fatigue specimens. The fatigue life was reduced substantially when a hollow thin-walled "shot" particle was located in proximity to the specimen surface.

Although the MMC fatigue specimens including the "blown" KAOWOOL fibers/particles exhibited improved fatigue life as compared to that of the 339 aluminum alloy sans reinforcement, the fatigue life was found to be limited by crack initiation at the hollow, thin-walled "shot" KAOWOOL particles present with the desirable KAOWOOL reinforcing fibers in the preform as incidental or pest particles as explained above.

The present invention is directed at overcoming the observed shortcomings in fatigue performance of the MMC's specimens made in the manner described above using preforms including the "blown" KAOWOOL fibers/particles. In particular, the present invention is directed at improving the fatigue properties by addressing and overcoming the adverse affects of the hollow, thin-walled "shot" particles that are present as incidental or pest particles together with the "blown" KAOWOOL fibers.

In particular, additional MMC test samples were made in accordance with an embodiment of the present invention using so-called "spun" KAOWOOL fibers obtained from the aforementioned Thermal Ceramic Corporation. The "spun" reinforcement fibers were made by impinging a stream of a molten Kaolin (aluminosilicate) directly on a set of rotating metal wheels in a manner that the molten ceramic is configured into elongated fibers with some non-fibrous "shot" particles also formed. The manufacturer separated most of the incidental "shot" particles from the solid elongated fibers using the same hydrocyclone and ultrasonic elutriation operations as used to manufacture the "blown" KAOWOOL fibers.

The aforementioned fiber manufacturer provided porous preforms comprising the "spun" KAOWOOL fibers/particles bonded together using a colloidal silica binder ((e.g. 5 weight % colloidal silica and balance water) applied as a coating on the fibers/particles. The preform was supplied with the same preform configuration and dimensions as those made using the "blown" KAOWOOL fibers/particles and using the same preform fabrication process.

The porous preforms made with the "spun" KAOWOOL fibers/particles were infiltrated with molten 339 aluminum alloy by squeeze casting using the same parameters as described above for squeeze casting of the preforms made using the "blown" KAOWOOL fibers/particles. Likewise, fatigue specimens were machined from the MMC castings and polished, heat treated and fatigue tested in the same manner as described above for MMC fatigue specimens made using the "blown" KAOWOOL fibers/particles.

Figure 4A:
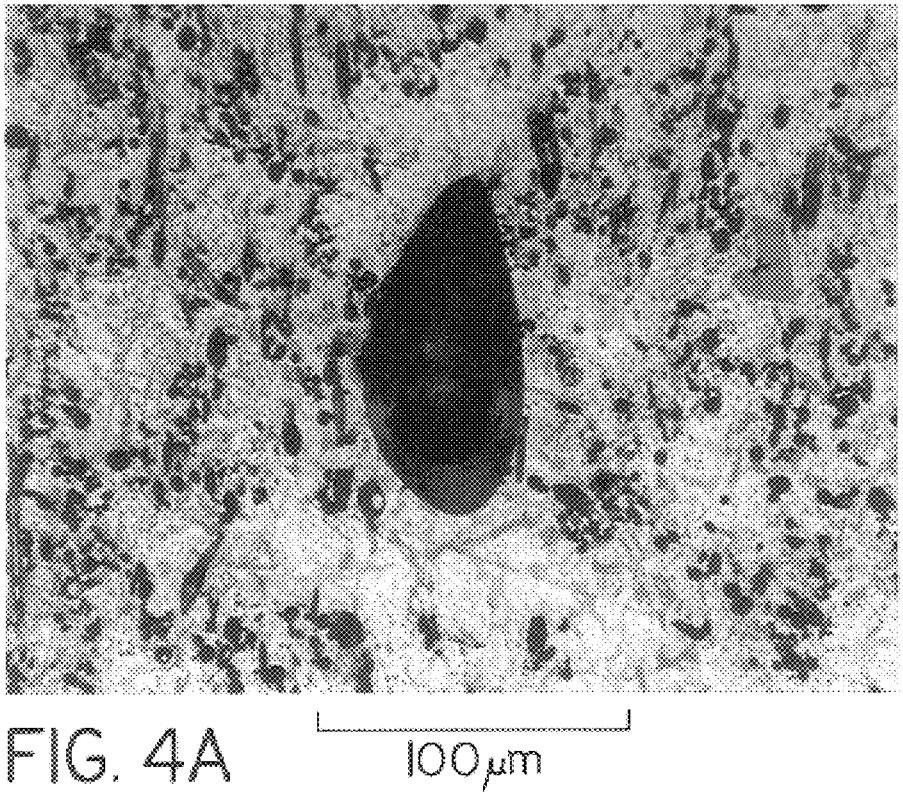
FIGS. 4A and 4B are optical micrographs of MMC test specimens incorporating "spun" KAOWOOL fiber reinforcements in the 339 aluminum alloy matrix showing thick-walled "shot" particles, the particle in FIG. 4A being empty and hollow and the particle in FIG. 4B being partially filled with the matrix alloy.
Figure 4B:
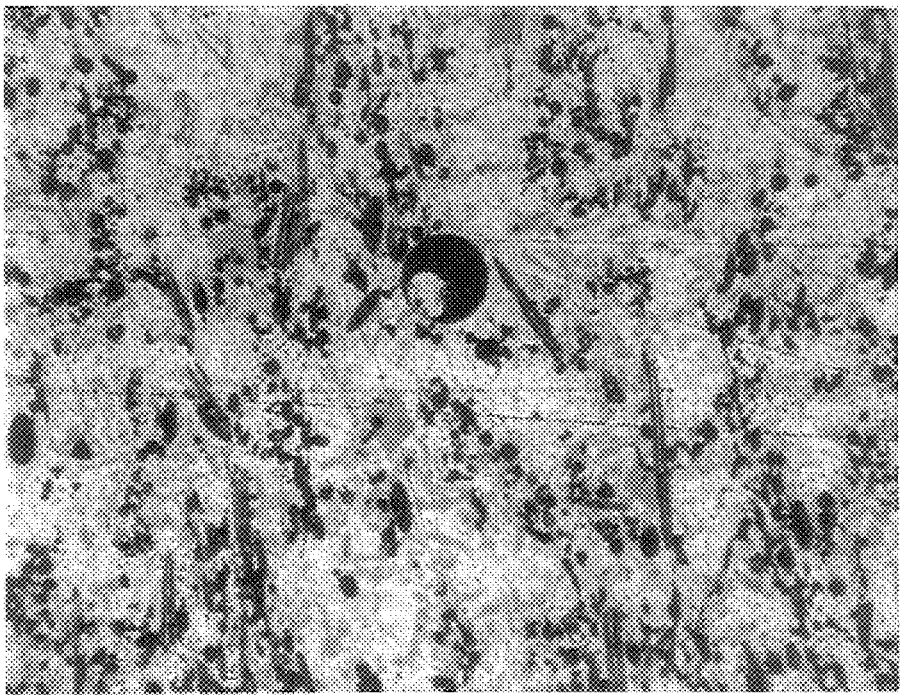

An area of approximately 20 $mm^2$ was surveyed on each polished section of the MMC specimens including the "spun" KAOWOOL fibers/particles. Typical, "shot" particles present in the matrix are illustrated in FIGS. 4A and 4B, which are scanning electron micrographs of the MMC with 15 volume % of the "spun" KAOWOOL fibers/particles. The "shot" particles were found to be approximately spheroid and mostly hollow, ranging in size up to approximately 100 microns in diameter. The particle shell wall thickness was not uniform, but the "shot" particles were found to comprise only thick-walled particles on the basis of the ratio of the shell wall thickness (t) to the particle shell external radius (a); namely, only thick-walled "shot" particles were found having t/a ratio equal to or greater than 0.2. No hollow, thin-walled "shot" particles having a t/a ratio equal to or less than 0.2 were present with the "spun" KAOWOOL fibers from metallographic examination of the MMC specimens.

The surface concentrations of the hollow thick-walled "shot" particles per one $mm^2$ of exterior specimen surface as observed by optical microscopy is summarized in Table I where only the thick-walled "shot" particles are observed to be present on the surface of the MMC specimens with 15 volume % "spun" fibers/particles.

Importantly, although the "spun" KAOWOOL fibers were similar in physical characteristics to the "blown" KAOWOOL fibers, the "shot" particles present as incidental or pest particles with the "spun" fibers after the hydrocyclone and ultrasonic elutriation separation operations did not include any thin-walled, hollow "shot" particles of the type present with the aforementioned "blown" KAOWOOL fibers. That is, thin-walled, hollow "shot" particles having a t/a ratio equal to or less than 0.2 were not present with the "spun" fibers.

Figure 5A:
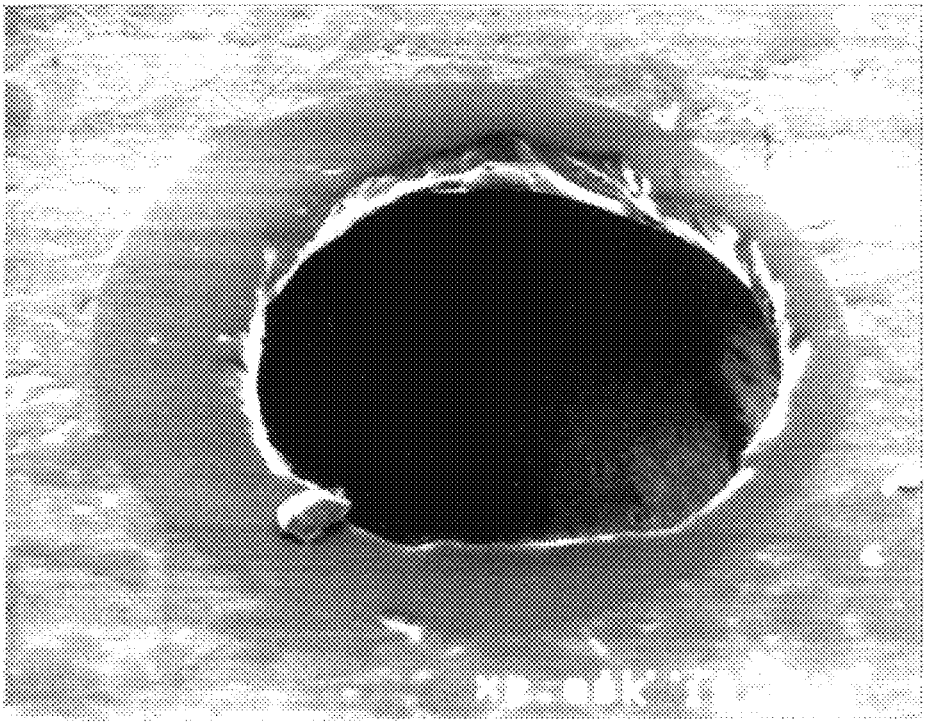
FIGS. 5A and 5B are scanning electron micrographs of MMC test specimens incorporating "spun" KAOWOOL fiber reinforcements in the 339 aluminum alloy matrix showing thick-walled "shot" particles, the particle in FIG. 5A being empty and hollow and the particle in FIG. 5B being solid ceramic.
Figure 5B:
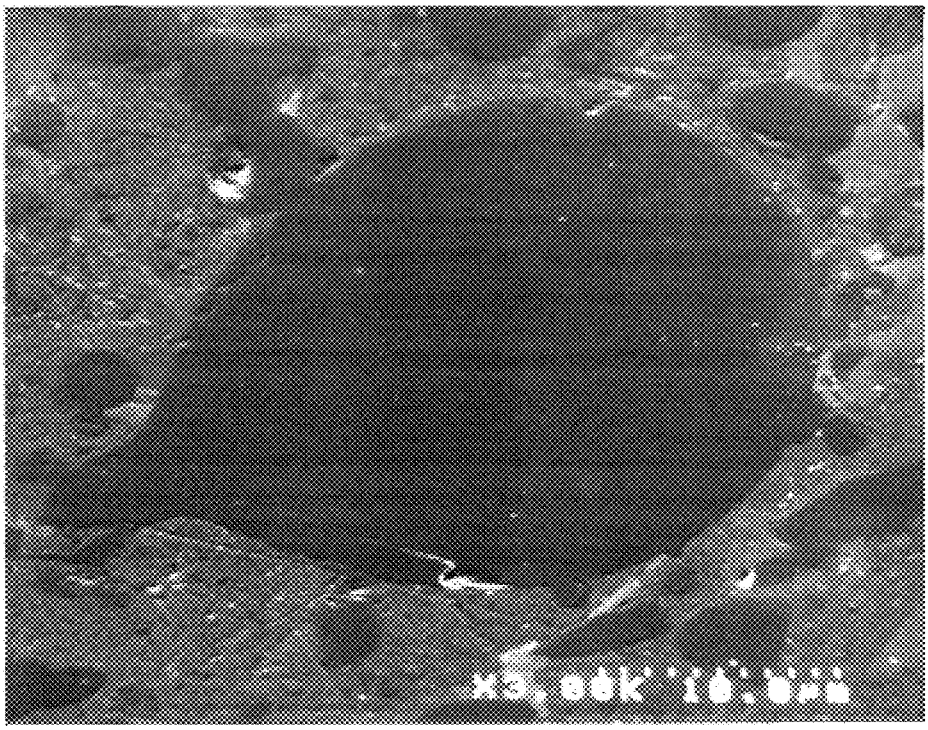

The thick-walled "shot" particles present with the "spun" fibers were typically hollow after the squeeze casting operation as shown in FIGS. 4A and 5A, although a very small percentage of the thick-walled "shot" particles were found to include some matrix alloy as a result of fracturing of those shells during squeeze casting. A very small fraction of the "shot" particles comprised solid KAOWOOL particles.

Referring to FIG. 1, the fatigue life as a function of cyclic stress (i.e. S-N curve) at 300 degrees C is shown and designated by the "○" data points for the metal matrix composite fatigue specimens using preforms comprising 15 volume % of the "spun" KAOWOOL fibers/particles relative to the specimen total volume. It is apparent that the fatigue specimens including the "spun" KAOWOOL fiber reinforcements/particles exhibited closely clustered data points which closely corresponded with the best (i.e. longest lived) specimens made using "blown" KAOWOOL fibers/particles.

The location of crack initiation was clearly defined on the fracture surface of the specimens with "spun" KAOWOOL fibers/particles, but no "shot" particles or other defects could be identified as the sites of crack initiation.

It is apparent that the MMC's including preforms comprising "spun" KAOWOOL fibers/particles provided elevated temperature fatigue properties superior to those exhibited by the MMC specimens including preforms comprising "blown" KAOWOOL fibers/particles. The latter specimens exhibited considerable scatter in fatigue life due to crack initiation at hollow, thin-walled "shot" pest particles in the vicinity of the free surface of the specimens, FIG. 2, whereas the fatigue life of the former specimens was quite well defined with no "shot" particles found as crack initiation sites at any fatigue fracture surfaces.

Figure 6:
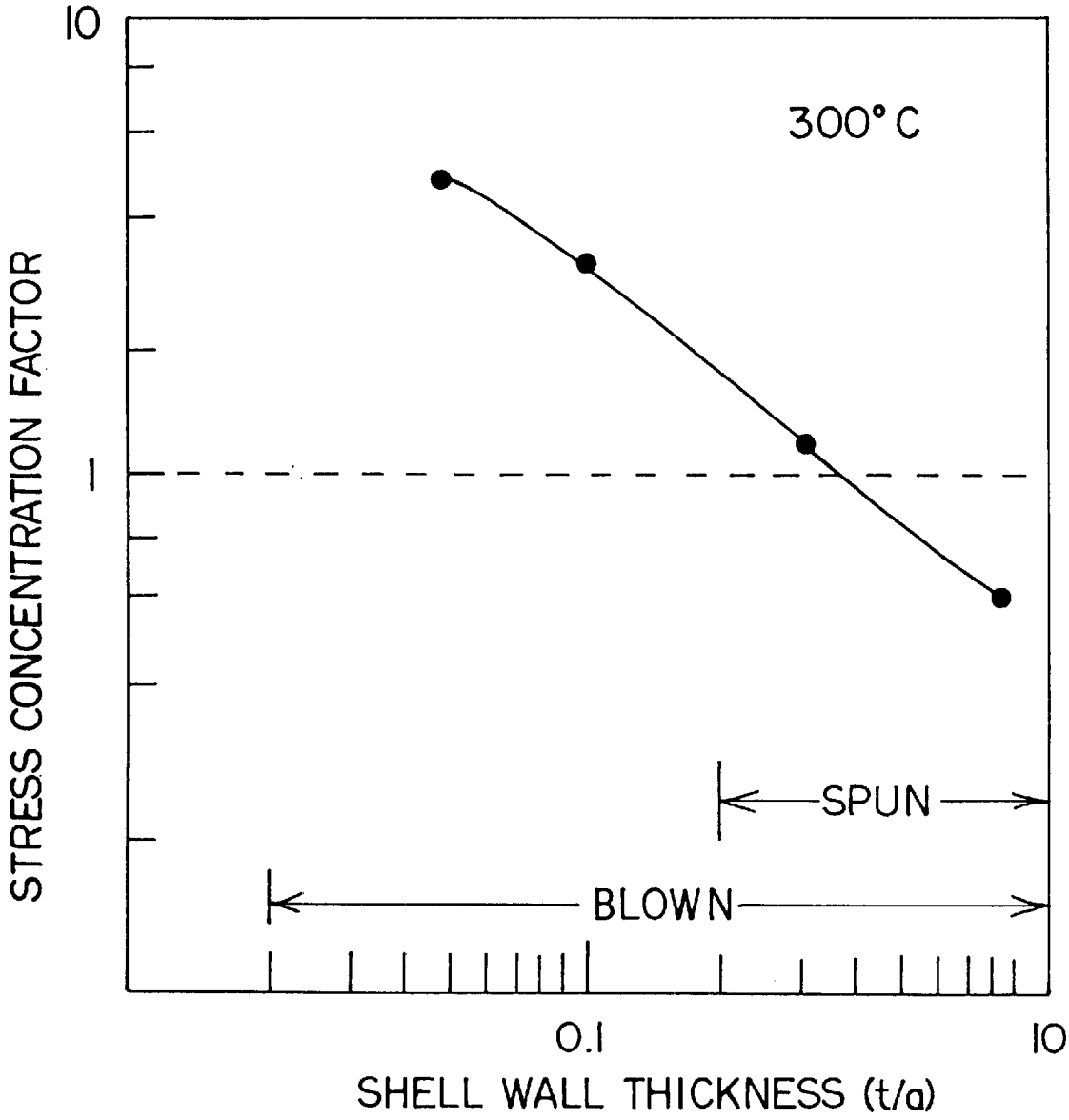
FIG. 6 is a graph depicting the effect of "shot" particle shell wall thickness on the maximum stress concentration factor in a metallic matrix at a location D when the particle is at a free surface, "Surface", of the MMC, FIG. 6A. The range of particle shell wall thicknesses of actual "shot" particles associated with "blown" and "spun" KAOWOOL fibers is indicated by the horizontal arrows in the figure.
Figure 6A:
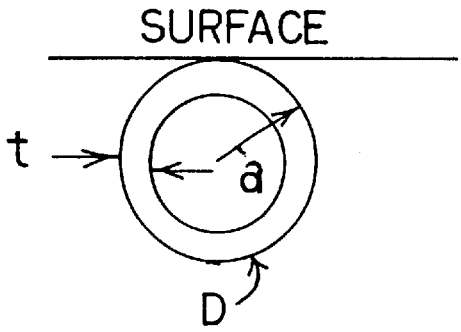

FIG. 6 is a graph generated by finite element analysis techniques depicting the effect of "shot" particle shell wall thickness on the maximum stress concentration factor in a matrix at a location D when the particle is at a free surface, "Surface", of the MMC, as shown in FIG. 6A. The ranges of shell wall thicknesses (t/a) of respective "shot" particles associated with "blown" and "spun" fibers are indicated by the horizontal arrows in the figure. It is apparent that the hollow, thin-walled "shot" particles found to be incidental with the "blown" KAOWOOL fibers exhibit large stress concentration factors relative to crack initiation in the matrix as compared to the thicker walled "shot" particles found to be incidental with the "spun" KAOWOOL fibers.

The stress concentration factor (SCF) in the matrix increases with decreasing shell wall thickness. There is a critical value of wall thickness (t/a) defined by the condition SCF=1. When SCF is less than 1, the hollow "shot" particle will act as reinforcement. When SCF is greater than 1, the hollow "shot" particle can act as a defect to initiate fatigue cracks. The critical shell wall thickness will depend on the ratio of the elastic modulus of the "shot" particle and that of the matrix. The embodiments of the invention described above using melt spun KAOWOOL fibers/particles in effect control "shot" particle shell wall thicknesses to this end; i.e. to provide shell walls thick enough to improve the fatigue properties of the composite.

MMC's in accordance with the present invention can be incorporated into or formed as an integral part of a piston of an internal combustion engine to improve fatigue properties thereof. For example, the piston crown, dome or region proximate the top ring groove can be cast using preforms to have an integral MMC structure pursuant to the invention to improve fatigue properties in those selective regions. MMC's in accordance with the present invention also can be incorporated in or formed as an integral part of a wide variety of other components as those skilled in the art will appreciate.

While the invention has been disclosed primarily in terms of specific embodiments thereof, it is not intended to be limited thereto but rather only to the extent set forth hereafter in the claims which follow.

What is claimed is:

1. Metal matrix composite, comprising of a metallic matrix having melt spun fibrous reinforcements and hollow non-fibrous particles disposed in said matrix, said fibrous reinforcements and said non-fibrous particles consisting of aluminosilicate, said non-fibrous particles consisting essentially of shells having shell walls with a wall thickness, t, and external shell radius, a, such that t/a is greater than about 0.2 and effective to avoid initiation of fatigue cracks at said non-fibrous particles located proximate an exterior surface of the metal matrix composite.

2. The composite of claim 1 wherein said fibrous reinforcements include said non-fibrous particles as incidental particles.

3. Metal matrix composite, comprising a metallic matrix comprising of aluminum or an aluminum alloy having melt spun fibrous reinforcements and hollow non-fibrous particles both consisting of aluminosilicate disposed in said matrix, said non-fibrous particles having shell walls with a wall thickness, t, and external shell radius, a, such that t/a is greater than about 0.2 and sufficient to avoid initiation of fatigue cracks at said non-fibrous particles located proximate an exterior surface of said composite.

4. The composite of claim 3 wherein said fibrous reinforcements include said non-fibrous particles as incidental particles.

5. A piston for an internal combustion engine including at least a selective region having a composite structure in accordance with claim 1.

6. A piston for an internal combustion engine including at least a selective region having a composite structure in accordance with claim 3.

* * * * *